US006736188B2

(12) United States Patent
Vining et al.

(10) Patent No.: US 6,736,188 B2
(45) Date of Patent: May 18, 2004

(54) APPARATUS FOR MOLDING MOLTEN MATERIALS

(75) Inventors: Ralph E. Vining, Brooklyn, MI (US); D. Matthew Walukas, Ypsilanti, MI (US); Raymond F. Decker, Ann Arbor, MI (US)

(73) Assignee: Thixomat, Inc., Ann Arbor, MI (US)

( * ) Notice: Subject to any disclaimer, the term of this patent is extended or adjusted under 35 U.S.C. 154(b) by 0 days.

(21) Appl. No.: 10/184,267

(22) Filed: Jun. 28, 2002

(65) Prior Publication Data

US 2004/0003911 A1 Jan. 8, 2004

(51) Int. Cl.[7] ..... B22D 17/00
(52) U.S. Cl. ..... 164/312; 164/113
(58) Field of Search ..... 164/113, 120, 164/312, 313, 314, 315, 316, 317, 318

(56) References Cited

U.S. PATENT DOCUMENTS 3,515,203 A * 6/1970 Parlanti et al. ..... 164/312
4,926,926 A * 5/1990 Zecman ..... 164/312
5,451,244 A 9/1995 Castledine
5,711,366 A 1/1998 Mihelich et al.
5,819,839 A 10/1998 Mihelich et al.

OTHER PUBLICATIONS

Development of HIP Consolidated P/M Superalloys for Conventional Forging to Gas Turbine Engine Components; Gernant E. Maurer, Wayne Castledine, Fredrick A. Schweizer, and Sam Mancuso, Superalloys 1996, pp. 645–652.

* cited by examiner

*Primary Examiner*—Kuang Y. Lin
(74) *Attorney, Agent, or Firm*—Brinks Hofer Gilson & Lione

(57) ABSTRACT

A vessel for processing feed stock material into molten or semi-molten state. The vessel includes a body defining an interior surface, an inlet, for receiving the feed stock material and an outlet discharging the material. The sidewall of the body comprises three layers, referred to as the shell, an intermediate layer and a liner. The intermediate layer is disposed between the shell and the liner and is formed of material softer than the materials forming the shell and the liner. The presence of the intermediate layer minimizes the thermal gradient along the thickness of the barrel.

57 Claims, 2 Drawing Sheets

APPARATUS FOR MOLDING MOLTEN MATERIALS

BACKGROUND OF THE INVENTION

1. Field of the Invention

The present invention relates to a vessel for the production of molten materials. More specifically, the present invention is a vessel optimized for the handling the processing environment involved in the production of molten or liquid metals and their molding into articles of manufacture.

2. Description of the Prior Art

Metal compositions having dendritic structures at ambient temperatures conventionally have been melted and then subjected to high pressure die casting procedures. These conventional die casting procedures are limited in that they suffer from porosity, melt loss, contamination, excessive scrap, high energy consumption, lengthy duty cycles, limited die life, and restricted die configurations. Furthermore, conventional processing promotes formation of a variety of microstructural defects, such as porosity, that require subsequent, secondary processing of the articles and also result in use of conservative engineering designs with respect to mechanical properties.

Processes are known for forming metal compositions such that their microstructures, when in the semi-solid state, consist of rounded or spherical, degenerate dendritic particles surrounded by a continuous liquid phase. This is opposed to the classical equilibrium microstructure of dendrites surrounded by a continuous liquid phase. These new structures exhibit non-Newtonian viscosity, an inverse relationship between viscosity and rate of shear. The materials themselves, in this condition, are known as thixotropic materials.

One process for converting a dendritic composition into a thixotropic material involves the heating of the metal composition or alloy, hereafter just "alloy", to a temperature which is above its liquidus temperature and then subjecting the liquid alloy to shear or agitation as it is cooled into the region of two phase equilibria. A result of sufficient agitation during cooling is that the initially solidified phases of the alloy nucleate and grow as rounded primary particles (as opposed to interconnected dendritic particles). These primary solids are comprised of discrete degenerate dendritic spherules and are surrounded by a matrix of an unsolidified portion of the liquid metal or alloy.

Another method for forming thixotropic materials involves the heating of the alloy to a temperature at which some, but not all of the alloy is in a liquid state. The alloy may then be agitated. The agitation converts any dendritic particles into degenerate dendritic spherules. In this method, it is preferred that when initiating agitation, the semisolid metal contain more liquid phase than solid phase.

An injection molding technique using thixotropic alloys delivered in an "as cast" state has also been seen. With this technique, the feed material is fed into a vessel where it may be further heated and at least partially melted. Next, the alloy is mechanically agitated by the action of a rotating screw, rotating plates or other means. As the material is processed, it is moved forward within the vessel. The combination of partial melting and simultaneous agitation produces a slurry of the alloy containing discrete degenerate dendritic spherical particles, or in other words, a semisolid state of the material and exhibiting thixotropic properties. The thixotropic slurry is delivered to another zone, which may be a second vessel, located adjacent a nozzle. The slurry may be prevented from leaking or drooling from the nozzle tip by controlled solidification of a solid metal plug of the material in the nozzle (by controlling the nozzle temperature). Alternatively, a mechanical or other valving scheme may be employed. The sealed nozzle provides protection to the slurry from oxidation, or the formation of oxide on the interior wall of the nozzle, that would otherwise be carried into the finished, molded part. The sealed nozzle further seals the die cavity on the injection side facilitating, if desired, the use of vacuum to evacuate the die cavity further enhancing the complexity and quality of parts so molded.

Once an appropriate amount of slurry for the production of the article has been accumulated in this zone, a piston, screw or other mechanism causes the material to be injected into the die cavity forming the desired solid article. Such casting or injection machines of the above or related varieties are herein referred to as semi-solid metal injection (SSMI) molding machines.

Currently, SSMI molding machines typically perform a substantial portion of the heating of the material in a barrel of the machine. Material enters at one section of the barrel while at a reduced temperature and is then advanced through a series of heating zones, where the temperature of the material is rapidly and, at least initially, progressively raised. The heating elements themselves, typically resistance or induction heaters, of the respective zones along the barrel may or may not be progressively hotter than the preceding heating elements. As a result, a thermal gradient exists both through the thickness of the barrel as well as along the length of the barrel.

Barrel construction for such machines has seen the barrels formed as long (up to 110 inches) and thick (outside diameters of up to 11 inches with 3 to 4 inch thick walls) monolithic cylinders. As the size and throughput capacities of these machines have increased, the length and thicknesses of the barrels have correspondingly increased. This has lead to increased thermal gradients throughout the barrels and previously unforeseen and unanticipated consequences. The primary barrel material, wrought alloy 718 (having a limiting composition of: nickel (plus cobalt), 50.00–55.00%; chromium, 17.00–21.00%; iron, bal.; columbium (plus tantalum) 4.75–5.50%, molybdenum, 2.80–3.30%; titanium, 0.65–1.15%; aluminum, 0.20–0.80; cobalt, 1.00 max.; carbon, 0.08 max.; manganese, 0.35 max.; silicon, 0.35 max.; phosphorus, 0.015 max.; sulfur, 0.015 max.; born, 0.006 max.; copper, 0.30 max. used in constructing these barrels is often in short supply and costly. Additionally, alloy 718 exhibits poor stress rupture properties, poor elongation and phase instability.

Fine grained alloy 718 of high quality is expensive and is available only as cast/wrought billet, which needs extensive boring and external machining to shape complex vessels. The scrap of alloy 718 generated by going this route can be as high as 50%. Additionally, alloy 718 is unstable at 600–700° C., tending to transform its fine gamma double prime hardening phase to a brittle delta phase. Impact energy (Charpy V-notch) and stress rupture strength can thus degrade.

HIPPING of complex net shapes of alloy 718 is desirable to increase yield and to apply liners. However, cast/wrought alloy 718 suffers grain growth to large grains of ASTM No. 00. Impact energy (Charpy V-notch) and stress rupture strength can again degrade. Powder metal alloy 718 retains finer grain size upon HIPPING but stress rupture properties (life and ductility) still suffer severely. Furthermore, Thixomolding®, semisolid metal injection molding of thixotropic alloys, is expanding into higher temperature alloys that impart additional instability to alloy 718.

In several cases, failed monolithic barrels have been analyzed and it determined that the barrels failed as a result of thermal stress and, more particularly, thermal shock in the cold or input end of the barrels. As used herein, the cold or input end of a barrel is that section or end where the material first enters into the barrel. It is in this section where the most intense thermal gradients are seen, particularly in an intermediate temperature region of the cold section, which is located downstream of where the material enters. Large grained alloy 718 has been especially prone to cracking under these high stress conditions.

During use of a SSMI molding machine, the solid material feedstock, which may be in a pellet and chip form, may be fed into the barrel while at ambient temperatures, approximately 75° F. Being long and thick, the barrels of these molding machines are, by their very nature, thermally inefficient for heating a material introduced therein. With the influx of "cold" feedstock, a region of the barrel becomes significantly cooled on its interior surface. The exterior surface of this region, however, is not substantially affected or cooled by the feedstock because the positioning of the heaters thereabout. A significant thermal gradient, measured across the barrel's thickness, is resultingly induced in this region of the barrel. Likewise, a thermal gradient is also induced along the barrel's length. In the region of the barrel where the highest thermal gradient has been found to develop, the barrel is heated more intensely as the heaters cycle "off" less frequently.

Within the barrel, shearing and moving of the feedstock longitudinally through the various heating zones of the barrel causes the feedstock's temperature to rise, equalize at the desired level when it reaches the opposing or hot end of the barrel. At the hot end of the barrel, the processed material exhibits temperatures generally in the range of 1050–1100° F. depending on the specific alloy being processed. For magnesium processing, the maximum temperatures to which the internal portions of the barrel is subjected are about 1180° F. The exterior of the barrel may be heated up to 1530° F. to achieve these temperatures.

As the feedstock is heated, the interior surface of the barrel correspondingly sees a rise in its temperature. This rise in interior surface temperatures occurs to some extent along the entire length of the barrel, including the section cooled by the influx of cold material, where its extent is lesser.

Once a sufficient amount of material is accumulated and the material exhibits its thixotropic properties, the material is injected into a die cavity having a shape conforming to the shape of the desired article of manufacture. Additional feedstock is then or continuously introduced into the cold section of the barrel, again lowering the temperature of the interior barrel surface.

As the above discussion demonstrates, the interior surface of the barrel, particularly in the region of the barrel where feed stock is introduced, experiences a cycling of its temperature during operation of the SSMI molding machine. This thermal gradient between the interior and exterior surfaces of the barrel has been seen to be as great as 350° C.

Since the nickel content of alloy 718 is subject to be corroded by molten magnesium, currently the most commonly used thixotropic material, the vessels for producing the thixotropic alloy have been lined with a sleeve of a magnesium resistant material. Several such known materials are Stellite 12 (nominally 30Cr, 8.3W and 1.4C; Stoody-Doloro-Stellite Corp.), PM 0.80 alloy (nominally 0.8C, 27.81Cr, 4.11W and bal. Co. with 0.66N) and Nb-based alloys (such as Nb-30Ti-20W). Other molten materials, such as aluminum are also highly corrosive and errosive of materials conventionally used for components of machines for forming thixotropic materials or otherwise processing these alloys.

Obviously, where liners are used, the coefficients of expansion of the vessel and the liner must be compatible with one another for proper working of the machine. One concern with lined vessels is delamination of the liner from the remainder of the vessel or shell. Analysis of severely stressed barrels has revealed that a gap opens between the liner and the shell. This gap in turn decreases heat transfer efficiency between the liner and shell, requiring still greater temperatures to be applied to the shell and producing greater thermal gradients through the vessel.

Because of the significant cycling of the thermal gradient in the vessel, the vessel experiences thermal fatigue and shock. This can further cause cracking in the vessel and in the liner. Once the vessel liner has become cracked, processed alloy can penetrate the liner and attack the vessel. Both the cracking of the liner and the attacking of the vessel by the alloy, have previously been found to have contributed to the premature failure of the barrels.

In response to the above listed and other deficiencies, a multi-piece barrel construction has been seen with one section of the barrel designed for preparation of the thixotropic material and the other section of the barrel designed for high pressure molding requirements. These sections are referred to as the cold and hot or outlet sections of the barrel, are constructed differently and are joined together.

In a multi-piece construction, the cold section is constructed with a relatively thin (and therefore lower hoop strength) section of a material. This material, which may also be lower in cost than the material of the hot section, exhibits improved thermal conductivity and has a decreased coefficient of thermal expansion relative to the hot section material. This material also exhibits good wear and corrosion resistance to the thixotropic material intended to be processed. Several preferred materials for the cold section of the barrel are stainless steel 422, T-2888 alloy, and alloy 909, which may be lined with an Nb-based alloy (such as Nb-30Ti-20W). The hot section is constructed of a relatively thick (and therefore high hoop strength), thermal fatigue resistant, creep resistant, and thermal shock resistant material. A configuration of the hot section was to use fine grain alloy 718 with a HIPPED in lining of an Nb-based alloy, such as Nb-30Ti-20W, for lower cost and better resistance from attack by the material being processed.

A nozzle section (which is coupled to the end of the hot section opposite the cold section), may be constructed in a manner to allow residual material in the nozzle to be solidified into a sealing plug. Otherwise, the nozzle may be provided with a mechanical sealing mechanism.

While the problem of large thermal gradients in a vessel are described above with some particularity to machines and vessels for semisolid metal injection molding, the problem of large thermal gradients in a melting or pressure vessel are also seen in a wide variety of other metal molding processes and apparatuses. While the known barrel or other vessel constructions work adequately for their intended purpose, there still exists a need for an improved vessel construction that minimizes thermal stresses and that provides long life under higher service temperatures.

BRIEF SUMMARY OF THE INVENTION

It is therefore a principle object of the present invention to fulfill that need by providing for an improved vessel construction for preparing molten or semi-molten metals, including, but not limited to, magnesium and aluminum.

One object of the present invention is to provide a construction having reduced thermal stresses under the above higher operating conditions.

A further object of the present invention is to provide a construction that provides a longer service life, even under higher service temperatures.

Another object of this invention is to provide a construction having deceased static and cyclic thermal stresses.

A still further object of this invention is to provide a construction that enables low cost and high production rates.

Another object of this invention is to provide one-step HIPPING of net shape components that perform with good stress rupture life, good ductility and good resistance to corrosion by liquid metals and air.

Yet another object of the present invention is to replace the shell of the barrel formed of Alloy 718 with a more stable, oxidant resistant, ductile fine grained alloy 720 or alloy of similar composition.

In achieving the above and other objects, the present invention provides a vessel for processing metallic material into a molten or semi-solid state. The vessel itself includes a body that defines a chamber into which the material is received. To receive the material, an inlet is further defined in this body. Additionally, to discharge the material from the chamber and the body, an outlet is also defined within the body. The body is further made up of a sidewall portion formed of three layers, an exterior layer, an interior layer, and an intermediate layer. The exterior layer is formed of a first material. The interior layer is formed of a second material that is different from the first material. Additionally, the interior layer defines the internal surface of the chamber mentioned above. Disposed between the interior and exterior layers is the intermediate layer. This layer is formed of a third material that is different from both the first material and the second material. The material of the intermediate layer is softer than the material of both the exterior layer and the interior layer and as such, it minimizes the thermal gradient experienced through the thickness of the vessel as well as along the length of the vessel. It bonds to the interior and exterior layers and blocks any liquid metal corrosion attack of the outer layer. By reducing this thermal gradient, stresses within the vessel are also reduced and a corresponding increase in the life of the vessel results.

Modification of the hardening mechanism of alloy 718 can stabilize the hardening mechanism and eliminate the delta phase precipitation. This affords Ni base superalloys greater strength at 600–750° C. with long-time life and retention of ductility. These alloys, e.g. alloy 720, use lower Nb and higher Ti+Al to attain a stable gamma prime phase. Furthermore, these preferred alloys can be HIPPED at high temperatures (e.g. 1150° C.) without the pronounced grain growth seen in cast/wrought alloy 718 and degradation of properties seen in powder metallurgy alloy 718 from grain boundary precipitates. Thus, 3 layer constructions of superalloy barrel, bond layer and liner can be HIPPED in one step to make net shapes that require little machining and material loss, hence lower cost.

Inserts for hot sprues and hot runners and shot sleeves can be constructed in the same 3 layer format.

Additional benefits and advantages of the present invention will become apparent to those skilled in the art to which the present invention relates from the subsequent description of the preferred embodiment and the appended claims, taken in conjunction with the accompanying drawings.

DETAILED DESCRIPTION OF THE INVENTION

Figure 1:
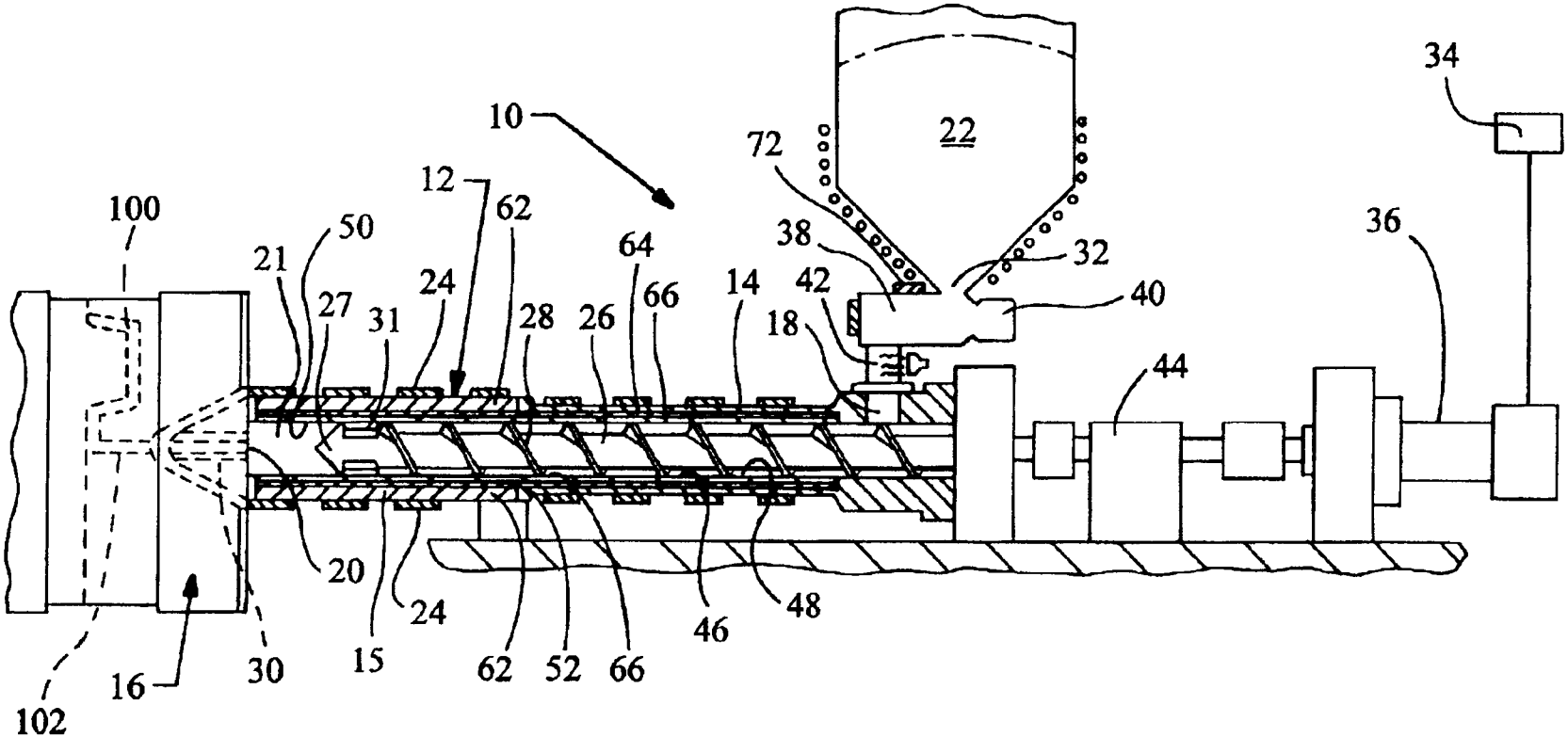
FIG. 1 is a general illustration of an apparatus having a portion of a vessel according to the present invention and used to convert feed stock material into a molten and/or semi-molten state.

Referring now to the drawings, a machine or apparatus for processing a metal material into a thixotropic state and molding the material to form molded, die cast, or forged articles, and constructed according to the present invention, is generally illustrated in FIG. 1 and designated at 10. Unlike typical die casting and forging machines, the present invention is adapted to use a solid state feed stock of metal or metal alloy (hereinafter just "alloy"). This eliminates the use of a melting furnace in die casting or forging processes along with limitations associated therewith. The apparatus 10 transforms the solid state feed stock into a semi-solid, thixotropic slurry which is then formed into an article of manufacture by either injection molding, die casting or forging.

While illustrated in connection with the apparatus 10 seen In FIG. 1, it will be understood and appreciated that the vessel construction detailed below will be applicable to the melting vessels of other machines used to melt metals. The present invention should therefore not be viewed as limited to a particular machine construction, as particular process for melting metal and alloys or use in melting only particular metals or alloys.

The apparatus 10, which is only generally shown in FIG. 1, includes a vessel or barrel 12 coupled to a mold 16. As more fully discussed below, the barrel 12 includes an inlet section 14, a shot section 15 and an outlet nozzle 30. An inlet 18 located in the inlet section 14 and an outlet 20 located in the shot section 15. The inlet 18 is adapted to receive the alloy feed stock (shown in phantom) in a solid particulate, palletized or chip form from a feeder 22 where the feed stock may be preheated.

It is anticipated that articles formed in the apparatus 10 will exhibit a considerably lower defect rate and lower porosity than non-thixotropically molded or conventional die cast articles. It is well known that by decreasing porosity the strength and ductility of the article can be increased. Obviously, any reduction in casting defects as well as any decrease in porosity is seen as being desirable.

One group of alloys which are suitable for processing in the apparatus 10 includes magnesium alloys and Al, Zn, Ti and Cu alloys. However, the present invention should not be interpreted as being so limited since it is believed that any metal or metal alloy which is capable of being processed into a semi-solid or liquid state will find utility with the present invention.

At the bottom of the feed hopper 22, the feed stock is gravitationally discharged through an outlet 32 into a volumetric feeder 38. A feed auger (not shown) is located within the feeder 38 and is rotationally driven by a suitable drive mechanism 40, such as an electric motor. Rotation of the auger within the feeder 38 advances the feed stock at a predetermined rate for delivery into the barrel 12 through a transfer conduit or feed throat 42 and the inlet 18. Other mechanisms for providing the feed stock to the inlet could alternatively be used.

Once received in the barrel 12, heating elements 24 heat the feed stock to a predetermined temperature so that the material is brought into its two phase region. In this two phase region, the temperature of the feed stock in the barrel 12 is between the solidus and liquidus temperatures of the alloy, partially melts and is in an equilibrium state having both solid and liquid phases.

The temperature control can be provided with various types of heating or cooling elements 24 in order to achieve this intended purpose. As illustrated, heating/cooling elements 24 are representatively shown in FIG. 1. Preferably, induction heating coils or band resistance heaters are used.

Temperature control means in the form of band heaters 24 is further placed about the nozzle to aid in controlling its temperature and readily permit the formation of a critically sized solid plug of the alloy. The plug prevents the drooling of the alloy or the back flowing of air (oxygen) or other contaminant into the protective internal atmosphere (typically argon) of the apparatus 10. Such a plug also facilitates evacuation of the mold 16 when desired, e.g. for vacuum assisted molding. As an alternative to the formation of a plug, mechanical sealing mechanisms, such as slide gates or other valves, could be used.

The apparatus may also include a stationary platen and moveable platen, each having respectively attached thereto a stationary mold half 16 and a moveable mold half. Mold halves include interior surfaces which combine to define a mold cavity 100 in the shape of the article being molded. Connecting the mold cavity 100 to the nozzle 30 are a runner, gate and sprue, generally designated at 102. Operation of the mold 16 is otherwise conventional and therefore is not being described in greater detail herein.

A reciprocating screw 26 is positioned in the barrel 12 and is rotated like the auger located within the feed cylinder 38 by an appropriate drive mechanism 44, such as an electric motor, so that vanes 28 on the screw 26 subject the alloy to shearing forces and move the alloy through the barrel 12 toward the outlet 20. The shearing action conditions the alloy into a thixotropic slurry consisting of spherulrites of rounded degenerate dendritic structures surrounded by a liquid phase. As an alternative to the screw 26, other mechanisms or means could be used to agitate the feed stock and/or move the feed stock through the barrel 12. Various types of rotating plates and gravity could, respectively, perform these functions.

During operation of the apparatus 10, the heaters 24 are turned on to thoroughly heat the barrel 12 to a desired temperature profile along its length. Generally, for forming thin section parts, a high temperature profile is desired, for forming mixed thin and thick section parts a medium temperature profile is desired and for forming thick section parts a low temperature profile is desired. Once thoroughly heated, the system controller 34 then actuates the drive mechanism 40 of the feeder 38 causing the auger within the feeder 38 to rotate. This auger conveys the feed stock from the feed hopper 22 to the feed throat 42 and into the barrel 12 through its inlet 18. If desired, preheating of the feed stock is performed in either the feed hopper 22, feeder 38 or feed throat 42 as described further below.

In the barrel 12, the feed stock is engaged by the rotating screw 26 which is being rotated by the drive mechanism 44 that was actuated by the controller 34. Within the bore 46 of the barrel 12, the feed stock is conveyed and subjected to shearing by the vanes 28 on the screw 26. As the feed stock passes through the barrel 12, heat supplied by the heaters 24 and the shearing action raises the temperature of the feed stock to the desired temperature between its solidus and liquidus temperatures. In this temperature range, the solid state feed stock is transformed into a semisolid state comprised of the liquid phase of some of its constituents in which is disposed a solid phase of the remainder of its constituents. The rotation of the screw 26 and vanes 28 continues to induce shear into the semisolid alloy at a rate sufficient to prevent dendritic growth with respect to the solid particles thereby creating a thixotropic slurry.

The slurry is advanced through the barrel 12 until an appropriate amount of the slurry has collected in the fore section 21 (accumulation region) of the barrel 12. The screw rotation is interrupted by the controller 34 which then signals an actuator 36 to advance the screw 26 and force the alloy through a nozzle 30 associated with the outlet 20 and into the mold 16. The screw 26 is initially accelerated to a velocity of approximately 1 to 5 inches/second. A non-return valve (not shown) prevents the material from flowing rearward toward the inlet 18 during advancement of the screw 26. This compacts the hot charge in the fore section 21 of the barrel 12.

For the nozzle 30 itself, materials of construction are alloy steel (such as T-2888), PM 0.8C alloys, and Nb-based alloys, such as Nb-30Ti-20W. In one preferred construction, the nozzle 30 is monolithically formed of one of the above alloys. In another preferred embodiment, the nozzle 30 is formed of alloy 720 and HIPPED to provide it with a resistant inner surface of an Nb-based alloy or PM 0.8C alloy.

Figure 2:
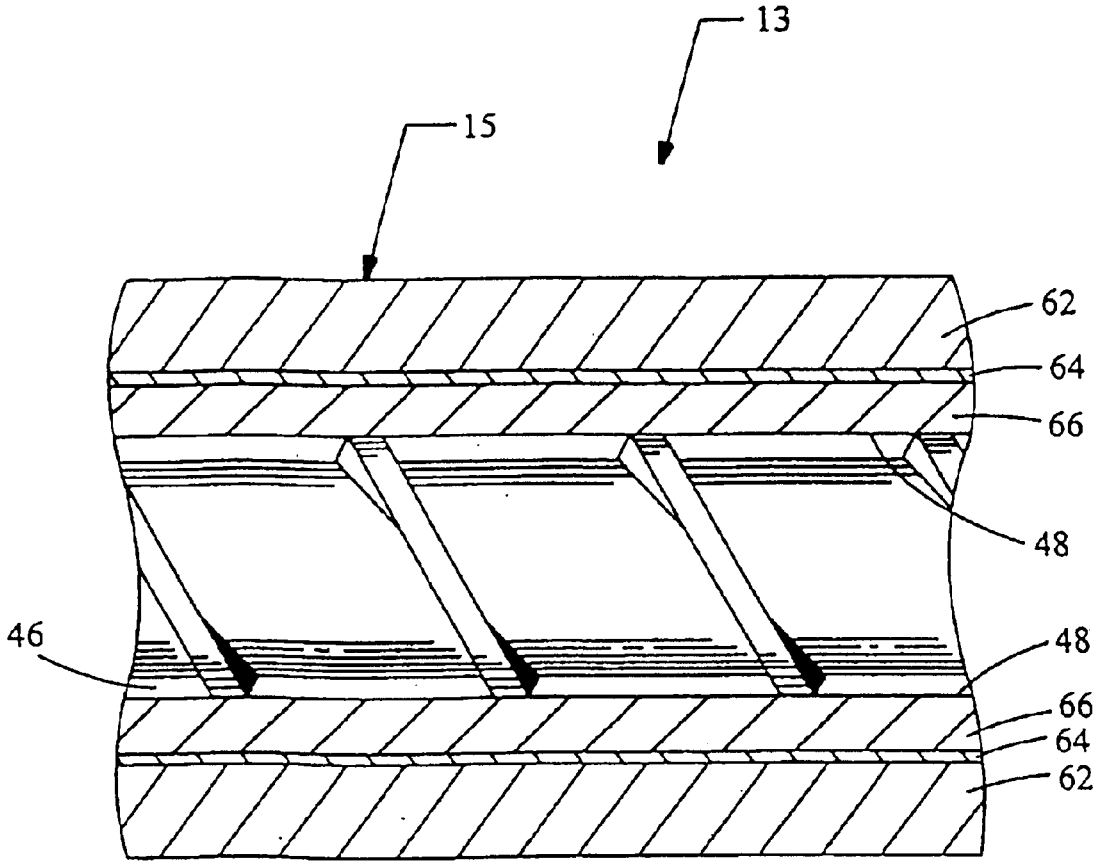
FIG. 2 is an enlarged view of a portion of a vessel have a three layer construction in accordance with the preferred embodiment of the present invention.

As seen in FIG. 2, the inlet section 14 of the barrel 12 matingly engages the shot section 15 so that a continuous bore 46 is cooperatively defined by the interior surfaces 48, 50 respectively of the inlet section 14 and shot section 15. To secure the two barrel sections 14, 15 together, the shot section 15 is provided with a radial flange 52 in which are defined mounting bores 54. Corresponding threaded bores are defined in the mating section 58 of the barrel's shot section 15. Threaded fasteners 60, inserted through the bores 54 in the flange 52, threadably engage the threaded bores 56 thereby securing the sections 14, 15 together. Obviously, a one-part barrel could be used in place of the two-part barrel 23, seen in FIG. 1, and constructed over its entire length according to the present invention, which will now be described in greater detail.

The barrel construction of the present invention overcomes the drawbacks of the prior art by minimizing the thermal gradient experienced through its thickness and along its length. Referring in particular to FIG. 2, the barrel 12 of the present invention comprises three layers, referred to as the shell 62, an intermediate layer 64 and a liner 66. As seen in FIG. 2, the intermediate layer 64 is disposed between the shell 62 and the liner 66. As will be explained later, the presence of the intermediate layer 64 minimizes the radial thermal gradient, through the thickness of the barrel 12.

Specifically, the intermediate layer 64 is relatively softer and more ductile than either the shell 62 or the liner 66. The intermediate layer 64 preferably, but may not, bonds the shell 62 of the barrel 12 to the liner 66 and when bonded, the intermediate layer 64 is preferably bonded to the shell and the liner by hot isostatic pressing (HIPPING). Additionally, the presence of an intermediate layer 64 prevents delamination of the shell from the liner, thereby increasing the overall stability of the barrel construction.

In the preferred embodiment of this invention, the intermediate layer 64 is formed of alloy of low carbon iron. Alternatively, other materials that do not form a brittle layer with the shell 62 or the liner 66 may be used. It is also preferred that the intermediate layer 64 is resistant to corrosion by Al, Mg or Zn. In order to enhance the durability of the barrel construction, the preferred thickness of the intermediate layer is in the range of 0.05 inches to 0.15 inches, and more preferably in the range of 0.6 to 0.12 inches.

Table I illustrates the effect of the intermediate layer 64 on the stress experienced by the barrel 12.

TABLE I

Shell (720 Alloy); Liner (T-20),

A. As fabricated

| Intermediate layer (inches) | Longitudinal Stress (ksi) | Hoop Stress (ksi) |
|---|---|---|
| 0 | −112 (liner) | −70 (liner) |
| | 62 (shell) | 30 (shell) |
| .12 | −73 (liner) | −8 (liner) |
| | 23 (shell) | 24 (shell) |

TABLE I-continued

Shell (720 Alloy); Liner (T-20),

B. Flood Feed ΔT = 273° F.

| Intermediate layer (inches) | Longitudinal Stress (ksi) | Radial stress (ksi) | Hoop Stress (ksi) | Von Misc. stress (ksi) |
|---|---|---|---|---|
| 0 | 43 (liner) | 43 (liner) | 61 (liner) | 75 (liner) |
| | 69 (shell) | 43 (shell) | 73 (shell) | |
| .06 | 10 (liner) | 28 (liner) | 35 (liner) | 43 (liner) |
| | 20 (shell) | 28 (shell) | 9 (shell) | |

As Table I shows, the presence of the intermediate layer reduces the stress on both the liner 66 and shell 62 during both fabrication and in service. Table II further illustrates the effect of the intermediate layer 64 on the stress using a barrel with a 1.85 inch HIPPED 720 shell; 0.2 inch thick stellite liner. The values in the table were measured at full startup with ΔT=403° F.

TABLE II

| Intermediate layer (inches) | Max liner Stress (ksi) | Max shell stress (ksi) |
|---|---|---|
| 0 | 43 | 55 |
| .06 | 32 | 42 |
| 0.12 | 34 | 38 |

The shell 62 is the outermost layer of the barrel 12. Preferably, the presence of intermediate layer 64 has allowed the material used in shell construction to be replaced with a material that exhibits the following properties: a deceased grain size after HIPPING, increased stress rupture properties, no softening or embrittlement by brittle delta phase precipitation, low coefficient of thermal expansion, increased resistance to oxidation and oxygen accelerated fatigue. One preferred material that exhibits the above properties is fine grained Alloy 720. Alloys generally similar to Alloy 720, as well as alloy 718 and alloy 720, are presented in Table III.

TABLE III

Comparison of properties of alloy 718 and other super alloys like 720

| Alloy | Cr | Co | Mo | W | Nb | Al | Ti | Al + Ti | UTS at 1200 F. ksi | UTS at 1400 F. ksi | YS at 1200 F. ksi | YS at 1400 F. ksi | Stress Rupture 1000/hr at 1200 F. ksi | Stress Rupture 1000/hr at 1400 F. ksi |
|---|---|---|---|---|---|---|---|---|---|---|---|---|---|---|
| 718 | 19 | — | 3 | — | 5.1 | .5 | .9 | 1.4 | 178 | 138 | 148 | 107 | 86 | 28 |
| Nimonic 105 | 15 | 20 | 5 | — | — | 4.7 | 1.2 | 5.9 | 159 | 85 | 111 | 107 | — | 48 |
| Nimonic 115 | 14.3 | 13.2 | — | — | — | 4.9 | 3.7 | 8.6 | 163 | 157 | 118 | 116 | — | 61 |
| Rene 95 | 14 | 8 | 3.5 | 3.5 | 3.5 | 3.5 | 2.5 | 6.0 | 212 | 170 | 177 | 160 | 125 | — |
| Udimet 500 | 18 | 12.5 | 4 | — | — | 2.9 | 2.9 | 5.8 | 176 | 151 | 110 | 106 | 110 | 47 |
| Udimet 520 | 19 | 12.0 | 6 | 1 | — | 2 | 3 | 5 | 170 | 105 | 115 | 105 | 85 | 50 |
| Udimet 700 | 15 | 17 | 5 | — | — | 4 | 3.5 | 7.5 | 180 | 100 | 124 | 120 | 102 | 62 |
| Udimet 710 | 18 | 15 | 3 | 1.5 | — | 2.5 | 5 | 7.5 | 187 | 148 | 120 | 118 | 126 | 67 |
| Udimet 720 | 17.9 | 14.7 | 3 | 1.3 | — | 2.5 | 5 | 7.5 | 211 | 211 | 164 | 152 | 125 | — |
| Waspaloy | 19.5 | 13.5 | 4.3 | — | — | 1.3 | 3 | 4.3 | 162 | 94 | 100 | 98 | 89 | 42 |
| Astroloy | 15 | 17 | 5.3 | — | — | 4.0 | 3.5 | 7.5 | 190 | 168 | 140 | 132 | 112 | 62 |

Table III above, illustrates the superior properties of the super alloy 720 when compared to alloy 718 and other alloys generally similar to alloy 720. Alternatively, other alloys exhibiting similar composition and properties may be used. Typically the composition range of such preferred super alloys is >10% Cr, >7.5% Co, >2.5% Mo, 0–6% W, <4% Nb, >2% Al, >2.4% Ti, >5.5% Al+Ti. In addition, ultimate tensile strength (UTS) at 1200° F. is preferably greater than 180 ksi and at 1400° F. is greater than 150 ksi. Similarly, the yield strength (YS) at 1200° F. is preferably greater than 140 ksi and at 1400° F. is greater than 130 ksi. The Stress Rupture strength for 1000 hr at 1200° F. is greater than 100 ksi and at 1400° F. greater than 60 Ksi. The preferred 720 alloy exhibits reduced grain size after HIPPING, stress rupture life at 1200° F. of 430 hrs. upon step loading from 100 to 130 ksi and 23% elongation. Further, the alloy 720 does not undergo any softening or embrittlement by delta precipitation in 50,000 hours at 1400° F. and also has a lower coefficient of thermal expansion (CTE) of 13.7. The alloy 720 also exhibits superior oxidation resistance and resistance to oxygen accelerated fatigue at 1200° F. by reducing the Nb content and increasing the Al content.

Table IV illustrates the creep properties and the stress rupture properties of Alloys 718 and 720, at 1200F. As seen from the table, the alloy 720 exhibits higher creep resistance and better strength than alloy 718. Additionally, Table V compares the embrittlement of the unstable alloy 718 with the stable low Nb Waspaloy during 5000 hrs. of simulated service, where "RA" stands for reduction of area and "CVN" stands for Charpy V-Notch toughness. As can be seen from Table V, at room temperature, the barrel using Waspaloy has a negligible loss in CVN. On the other hand alloy 718 exhibits a sharp CVN loss, which reduces the life of the barrel.

TABLE IV

A. Creep properties

| | 1000 hr Rupture Strength (Mpa) | | Strength at Larson-Miller No. (Mpa) | | |
|---|---|---|---|---|---|
| Alloy | 1200 F. | 1400 F. | 39 | 43 | 44 |
| 718 | 595 | 195 | 470 | 185 | 140 |
| 720 | 615 | 290 | 800 | 280 | 245 |

B. Stress Rupture properties at 1200 F.

| Alloy | Grain Size | Condition | Stress MPa | Life Hr | Elongation % |
|---|---|---|---|---|---|
| 718 | 8 | Cast/wrought | 100 | 156 | 8 |
| 718 | 00 | Cast/wrought HIPPED | 100 | 5–79 | 1.8–8.7 |
| 718 | 9 | Powder metallurgy HIPPED | 100 | 36 | 4.6 |
| 720 | 9 | Powder metallurgy HIPPED | 100, stepped to 130 | >430 | 7.4–23.7 |

TABLE V

| | At room Temperature | | | | At 1300 F. | | |
|---|---|---|---|---|---|---|---|
| Alloy | YS | UTS | RA | CVN | YS | UTS | CVN |
| 718 | 1192 (Before) | 1352 (Before) | 49 (Before) | 50 (Before) | 904 (Before) | 998 (Before) | 29 (Before) |
| | 840 (After*) | 1223 (After) | 17 (After) | 9 (After) | 556 (After) | 817 (After) | 76 (After) |
| 720 | 1118 (Before) | 1461 (Before) | 31 (Before) | 46 (Before) | 979 (Before) | 1105 (Before) | 53 (Before) |
| | 1098 (After) | 1460 (After) | 36 (After) | 39 (After) | 883 (After) | 1088 (After) | 52 (After) |

*After 5000 hrs at 1300 F. or 1 year service

In addition, the presence of the intermediate layer enables the shell thickness to be reduced, thereby enhancing heat transfer, reducing stress and reducing the thermal gradient across the barrel 12. Without the present invention, the thickness of the shell was typically in the range of 1.85 inches to 3.678 inches.

Using the present invention, use of shell thicknesses of less than 1.85 inches has become possible. It is anticipated that shell thicknesses using the invention will be in the range of 1.0 to less than 1.85 inches, and more preferably in the range of 1.25 to 1.75 inches.

Table VI illustrates the effect of the shell 62 thickness on stress on the barrel 12. For the data reported in Table VI, the materials used in the shell 62, the intermediate layer 64 and the liner 66 are, respectively, HIP 720 Alloy for the shell; 0.2 inch, T-20 liner; and 0.06 inch, Iron intermediate layer.

TABLE VI

Flood feed

| Shell Thickness (inches) | ΔT, ° F. | Longitudinal Stress (ksi) | Radial stress (ksi) | Hoop Stress (ksi) | Von Misc. stress (ksi) |
|---|---|---|---|---|---|
| 1.85 | 273 | 8 (liner) | 20 (liner) | 25 (liner) | 35 (liner) |
| | | 16 (shell) | 20 (shell) | 32 (shell) | |
| 1.00 | 125 | 0 (liner) | −4 (liner) | 0 (liner) | 6 (liner) |
| | | 12 (shell) | −4 (shell) | 0 (shell) | |

By employing the intermediate layer described above, changes in liner composition and construction are also enabled. Specifically, a refractory alloy liner, based on alloying elements of high peritectic temperatures or melting points in the binary phase diagrams are utilized. Such refractory metal and elements have the following features: low coefficient of expansion (and resulting decreases in stresses in both the liner and shell); low modulus of elasticity (E); high thermal conductivity; good corrosion resistance to the material being processed; and enhanced strength, toughness and hardness.

One preferred material for the liner 66, particularly when processing Mg, Al, or Zn, is an Nb-alloy, more specifically T-20, T-22 and T-23 Nb-alloys. Because of the intermediate layer 64, the liner 66 thickness can be substantially reduced from those currently used, 0.5 inches and greater. With the present invention, liner thicknesses can be reduced below 0.5 inches. As a practical matter, it is believed that the lower limit on the liner thickness is about 0.15 inches, although lesser thicknesses may be possible. Preferably, liner thickness range is about 0.15 inches to less than 0.50 inches, and more preferably in the range of 0.15 inches to 0.25 inches.

Table VII illustrates the effect of the liner composition, the Nb-alloy compositions mentioned above, on thermal shock (TS) and combined stresses.

TABLE VII

| Liner Material | TS, ksi ΔT = 100° F. | Combined stress, ksi (ΔT + TS) |
|---|---|---|
| Stellite | 32 | 101–125 |
| NB-Alloy | 12 | 12–47 |

Table VIII illustrates data for the effect of liner material on the stresses. The first part of the table shows stress value during flood feed at ΔT=273° F. and the second part of the table is during initial full power start-up at ΔT=403° F.

TABLE VIII

A. Shell, 1.85 inches and 718 alloy; Flood Feed with ΔT = 273° F.

| Linear Material | Method | Thickness (inches) | Longitudinal Stress (ksi) | Radial stress (ksi) | Hoop Stress (ksi) | Von Misc. stress (ksi) |
|---|---|---|---|---|---|---|
| Stellite (no intermediate layer) | Shrink | 0.5 | 69 (liner)<br>13 (shell) | 32 (liner)<br>32 (shell) | 62 (liner)<br>16 (shell) | 70 (liner) |
| T-20 (intermediate layer, 0.06 inches) | HIPPING | 0.2 | 10 (liner)<br>20 (shell) | 28 (liner)<br>28 (shell) | 35 (liner)<br>19 (shell) | 43 (liner) |

B. Shell, 1.85 inch and 718 alloy; Full Power Startup with ΔT = 403° F.

| Liner Material | method | Thickness (inches) | Longitudinal Stress (ksi) | Radial stress (ksi) | Hoop Stress (ksi) | Von Misc. stress (ksi) |
|---|---|---|---|---|---|---|
| Stellite (no intermediate layer) | Shrink | 0.5 | 107- liner<br>38- shell | 43- liner<br>43- shell | 102- liner<br>26- shell | 111-liner yields at 600° F. |
| T-20 (intermediate layer, 0.12 inches) | HIPPING | 0.2 | 43- liner<br>62- shell | 59- liner<br>59- liner | 55- liner<br>69- shell | 58-liner shell does not yield |

As seen from the above tables, the use of the intermediate layer 64 reduces the stress on the shell 62 or the liner 66. In essence, the intermediate layer 64 acts as a buffer zone thereby preventing premature cracking of the shell 62.

Liner thickness also has an effect on stress and Table IX illustrates that effect for T-20 liner. As in the above tables, the shell is alloy 720 and 1.85 inches thick, the liner is T-20 alloy, and operating conditions are flood feed with ΔT=273° F.

TABLE IX

| T-20 Liner Material thickness (Inches) | method | Longitudinal Stress (ksi) | Radial stress (ksi) | Hoop Stress (ksi) | Von Misc. stress (ksi) |
|---|---|---|---|---|---|
| 0.1 | Liner<br>Shell | 12<br>21 | 22<br>22 | 31<br>49 | 55 |

TABLE IX-continued

| T-20 Liner Material thickness (Inches) | method | Longitudinal Stress (ksi) | Radial stress (ksi) | Hoop Stress (ksi) | Von Misc. stress (ksi) |
|---|---|---|---|---|---|
| 0.2 | Liner<br>Shell | 8<br>16 | 20<br>20 | 25<br>32 | 35 |

Thicknesses for the liner could be increased beyond 0.2 inches, however, such increases also increase the overall cost of the barrel and actually sacrifice the strength of the barrel.

From the above, it is seen that the present invention offers many benefits and advantages in the construction of vessels for melting metals and alloys. While the above description constitutes the preferred embodiment of the present invention, it will be appreciated that the invention is susceptible to modification, variation and change without departing from the proper scope and fair meaning of the accompanying claims.

What is claimed is:

1. A barrel or shot sleeve of a casting apparatus for processing a metallic material into a molten or semisolid state, said barrel or shot sleeve comprising:

a body defining a chamber therein, an inlet in communication with said chamber to permit the introduction of material into said chamber, an outlet in communication with said chamber to permit the discharging of material from said chamber, said body further including a sidewall portion having an exterior layer formed of a first material, an interior layer formed of a second material and defining an internal surface of said chamber, said second material being different from said first material; and an intermediate layer disposed between said exterior layer and said interior liner and bonding said exterior layer to said interior layer, said intermediate layer being formed of a third material, said third material being different from said first material and said second material; and said first material having the following Ni base composition, in weight percent: greater than 10% Cr, greater than 7.5% Co, greater than 2.5% Mo, in the range of 0–6% W, less than 4% Nb, greater than 2% Al, greater than 2.4% Ti and greater than 5.5% of Al+Ti such that said first material resists delta phase embrittlement.

2. The barrel or shot sleeve claim 1 wherein said third material is softer than said first and second materials.

3. The barrel or shot sleeve of claim 1 wherein said intermediate layer is of a thickness less than 0.2 inches.

4. The barrel or shot sleeve of claim 1 wherein said intermediate layer is of a thickness less than 0.10 inches.

5. The barrel or shot sleeve of claim 1 wherein said intermediate layer is of a thickness of about 0.06 inches.

6. The barrel or shot sleeve of claim 1 wherein said intermediate layer is resistant to corrosion by Al, Mg, or Zn.

7. The barrel or shot sleeve of claim 1 wherein said intermediate layer is iron.

8. The barrel or shot sleeve of claim 1 wherein said Intermediate layer is low carbon iron.

9. The barrel or shot sleeve of claim 1 wherein said first material is Alloy 720.

10. The barrel or shot sleeve of claim 1 wherein said second material is an Nb-alloy.

11. The barrel or shot sleeve of claim 1 wherein said interior layer is less than 0.5 inches in thickness.

12. The barrel or shot sleeve of claim 1 wherein said interior layer is less than 0.25 inches in thickness.

13. The barrel or shot sleeve of claim 1 wherein said interior layer is less than 0.15 inches in thickness.

14. The barrel or shot sleeve of claim 1 wherein said exterior layer has a thickness of less than 1.75 inches.

15. The barrel or shot sleeve of claim 1 wherein said exterior layer has a thickness of less than 1.25 inches.

16. The barrel or shot sleeve of claim 1 wherein said exterior layer has a coefficient of thermal expansion from room temperature to 650 C. of less than $14\times10^{-6}/°$ F.

17. The barrel or shot sleeve of claim 1 wherein said first material is a HIPPED material.

18. The barrel or shot sleeve of claim 1 wherein said second material is a HIPPED material.

19. The barrel or shot sleeve of claim 1 wherein said third material is a HIPPED material.

20. The barrel or shot sleeve of claim 1 wherein said first material, said second material and said third material are all HIPPED materials.

21. The barrel or shot sleeve of claim 1 wherein said first material, said second material and said third material are HIPPED materials all formed in a one step process.

22. The barrel or shot sleeve of claim 21 wherein said one step process is simultaneously performed on said first, second and third materials.

23. The apparatus of claim 1 wherein said intermediate layer bonds said exterior layer to said interior layer.

24. A barrel or shot sleeve of a casting apparatus for processing a metallic material into a molten or semisolid state, said barrel or shot sleeve comprising:

a body defining a chamber therein, an inlet in communication with said chamber to permit the introduction of material into said chamber, an outlet in communication with said chamber to permit the discharging of material from said chamber, said body further including a sidewall portion having an exterior layer formed of a first material, an interior layer formed of a second material and defining an internal surface of said chamber, said second material being different from said first material; and an intermediate layer disposed between said exterior layer and said interior liner and bonding said exterior layer to said interior layer, said intermediate layer being formed of a third material, said third material being different from said first material and said second material; and said second material being selected from a group consisting of Nb-alloy T-20, T-22 or T-23.

25. The barrel or shot sleeve of claim 24 wherein said intermediate layer has a thickness of less than 0.2 inches.

26. The barrel or shot sleeve of claim 24 wherein said intermediate layer has a thickness of less than 0.10 inches.

27. The barrel or shot sleeve of claim 24 wherein said intermediate layer is resistant to corrosion by Al, Mg, or Zn.

28. The barrel or shot sleeve of claim 24 wherein said intermediate layer is iron.

29. The barrel or shot sleeve of claim 24 wherein said intermediate layer is low carbon iron.

30. The barrel or shot sleeve of claim 24 wherein said first material is Alloy 720.

31. The barrel or shot sleeve of claim 24 wherein said second material is an Nb-alloy.

32. The barrel or shot sleeve of claim 24 wherein sold liner is less than 0.5 inches thick.

33. The barrel or shot sleeve of claim 24 wherein said liner is less than 0.25 inches thick.

34. The barrel or shot sleeve of claim 24 wherein said liner is less than 0.15 inches thick.

35. The barrel or shot sleeve of claim 24 wherein said shell has a thickness of less than 1.75 inches.

36. The barrel or shot sleeve of claim 24 wherein said shell has a thickness of less than 1.25 inches.

37. The barrel or sleeve of claim 24 wherein said shell has a coefficient of thermal expansion of less than $14\times10^{-6}/°$ F.

38. The barrel or shot sleeve of claim 24 wherein said shell is of HIPPED material.

39. The barrel or shot sleeve of claim 24 wherein said intermediate layer is of HIPPED material.

40. The barrel or shot sleeve of claim 24 wherein said liner is of HIPPED material.

41. The barrel or shot sleeve of claim 24 wherein said shell, said liner and said intermediate layer are all of HIPPED material.

42. The barrel or shot sleeve of claim 24 wherein said shell, said liner and said intermediate layer are all HIPPED in one processing step.

43. The apparatus of claim 24 wherein said intermediate layer bonds said exterior layer to said interior layer.

44. A casting apparatus for processing a feed stock material into molten or semi-molten state, said a comprising:

a processing barrel or shot sleeve having an interior surface defining a central chamber, an inlet in communication with sold central chamber, an outlet in communication with said central chamber, and an outlet end, said barrel or shot sleeve having a sidewall defined by a shell, a liner and an intermediate layer:

said shell defining an outer layer formed of a first material;

said liner being an interior layer defining said interior surface, said liner being formed of a second material different from said first;

said intermediate layer disposed between said shell and said liner and bonding said shell to said liner, wherein said intermediate layer is formed of a third material, said third material being more ductile than the said first material and said second material;

a feeder coupled to said barrel or shot sleeve to introduce said material thereinto through said inlet;

moving means for moving said material through said barrel or shot sleeve;

discharge means for discharging said material from said outlet of said barrel or shot sleeve in a molten or semi molten state; and said first material having the following Ni base composition, in weight percent: greater than 10% Cr, greater than 7.5% Co, greater than 2.5% Mo, 0–6% W, less than 4% Nb, greater than 2% Al, greater than 2.4% Ti and greater than 5.5% of Al+Ti such that said first material prevents delta phase embrittlement.

45. The apparatus of claim 44 further including shearing means located within said central chamber, said shearing means inducing shear in said material sufficient to inhibit dendritic growth in said materials.

46. The apparatus of claim 45 wherein said shearing means is a screw.

47. The apparatus of claim 44 wherein said moving means is a screw.

48. The apparatus of claim 44 wherein said discharge means includes longitudinally moveable member.

49. The apparatus of claim 48 wherein said discharge means includes a reciprocating screw.

50. The apparatus of claim 44 wherein said intermediate layer bonds said shell to said liner.

51. A casting apparatus for processing a feed stock material into molten or semi-molten state, said a comprising:

a processing barrel or shot sleeve having an interior surface defining a central chamber, an inlet in communication with said central chamber, an outlet in communication with said central chamber, and an outlet end, said barrel or shot sleeve having a sidewall defined by a shell, a liner and an intermediate layer:

said shell defining an outer layer formed of a first material;

said liner being an interior layer defining said interior surface, said liner being formed of a second material different from said first;

said intermediate layer disposed between said shell and said liner and bonding said shell to said liner, wherein said intermediate layer is formed of a third material, said third material being more ductile than the said first material and said second material;

a feeder coupled to said barrel or shot sleeve to introduce said material thereinto through said inlet;

moving means for moving said material through said barrel or shot sleeve;

discharge means for discharging said material from said outlet of said barrel or shot sleeve in a molten or semi molten state; and said second material being selected from a group consisting of Nb-alloy T-20, T-22 and T-23.

52. The casting apparatus of claim 51 further including a shearing means located within a central chamber, said shearing means inducing shear in said material sufficient to inhibit dendritic growth in said materials.

53. The casting apparatus of claim 52 wherein said shearing means is a screw.

54. The casting apparatus of claim 51 wherein said moving means is a screw.

55. The casting apparatus of claim 51 wherein said discharge means includes a longitudinally moveable member.

56. The casting apparatus of claim 55 wherein said discharge means includes a reciprocating screw.

57. The apparatus of claim 51 wherein said intermediate layer bonds said shell to said liner.

* * * * *

UNITED STATES PATENT AND TRADEMARK OFFICE

CERTIFICATE OF CORRECTION

PATENT NO. : 6,736,188 B2
DATED : May 18, 2004
INVENTOR(S) : Ralph E. Vining et al.

It is certified that error appears in the above-identified patent and that said Letters Patent is hereby corrected as shown below:

Column 16,
Line 23, after "wherein" delete "sold" and substitute -- said -- in its place.
Line 49, after "state, said" delete "a" and substitute -- apparatus -- in its place.
Line 52, after "with" delete "sold" and substitute -- said -- in its place.

Column 17,
Line 27, after "state, said" delete "a" and substitute -- apparatus -- in its place.

Signed and Sealed this

Twenty-third Day of November, 2004

JON W. DUDAS
*Director of the United States Patent and Trademark Office*